US008070330B2

(12) United States Patent
Su

(10) Patent No.: US 8,070,330 B2
(45) Date of Patent: Dec. 6, 2011

(54) FLOATING LAMP SYSTEM

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 308 days.

(21) Appl. No.: 12/566,684

(22) Filed: Sep. 25, 2009

(65) Prior Publication Data

US 2011/0019394 A1 Jan. 27, 2011

(30) Foreign Application Priority Data

Jul. 22, 2009 (CN) ..... 2009 1 0304684

(51) Int. Cl.
*F21V 29/00* (2006.01)

(52) U.S. Cl. ..... 362/373; 362/147; 362/153

(58) Field of Classification Search ..... 362/373, 362/147, 153, 391, 394, 802
See application file for complete search history.

(56) References Cited

U.S. PATENT DOCUMENTS

| | | | | |
|---|---|---|---|---|
| 4,542,445 | A * | 9/1985 | Marletta | 362/96 |
| 6,146,001 | A * | 11/2000 | Cwiakala | 362/267 |
| 2008/0051003 | A1* | 2/2008 | Hom | 446/473 |
| 2008/0084689 | A1* | 4/2008 | Fletcher | 362/184 |
| 2008/0207083 | A1* | 8/2008 | Schnuckle | 446/220 |
| 2009/0133299 | A1* | 5/2009 | Blackwell | 362/35 |

* cited by examiner

*Primary Examiner* — David V Bruce
(74) *Attorney, Agent, or Firm* — Altis Law Group, Inc.

(57) ABSTRACT

A floating lamp system is provided. The system includes an object having a first inner wall and a second inner wall. A first conductive element is mounted on the first sidewall and electrically connected to the anode of a power source. A second conductive element is mounted on the second wall and electrically connected to the cathode of the power source. The system further includes a floating lamp having a balloon and a lighting element mounted in the balloon. An anode contact point is mounted on the top of the balloon and a cathode contact point is mounted on the bottom of the balloon. The lighting element is electrically connected to the anode contact point and the cathode contact point. When the floating lamp floats, causing the anode contact point to contact with the first conductive element, the lighting element is lit up.

4 Claims, 1 Drawing Sheet

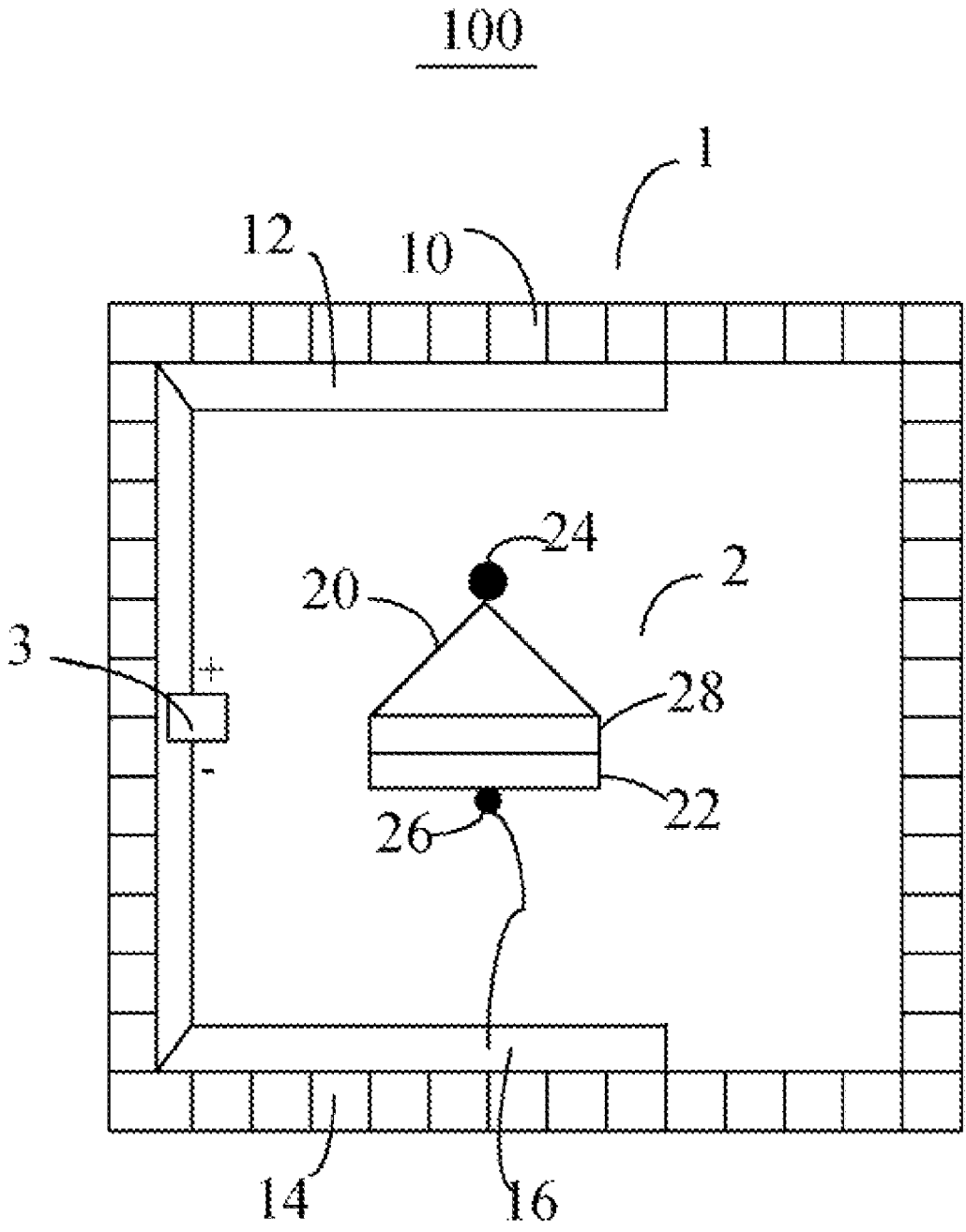
100
1
12
10
24
2
20
3
+
28
-
22
26
14
16

FLOATING LAMP SYSTEM

BACKGROUND

1. Technical Field

The present disclosure relates to lamp systems and, particularly, to a system in which a floating lamp is capable of automatically lighting up when floating.

2. Description of Related Art

Track lights are very popular. For example, in a product exhibition, track lights can light up the products from many directions. However, the track lights must rely on the complex structure of the tracks.

BRIEF DESCRIPTION OF THE DRAWINGS

The components of the drawing are not necessarily drawn to scale, the emphasis instead being placed upon clearly illustrating the principles of the floating lamp system.

The drawing is a schematic view of the floating lamp system in accordance with an exemplary embodiment.

DETAILED DESCRIPTION

Referring to the drawing, an embodiment of a floating lamp system 100 is illustrated. The system 100 includes an object 1 and a floating lamp 2.

The object 1 includes two opposite inner walls, a top wall or ceiling 10 and a bottom wall or floor 14. A first conductive element 12 is mounted on the ceiling 12, and a second conductive element 16 is mounted on the floor 14. The first conductive element 12 is electrically connected to the anode of a power source 3, and the second conductive element 16 is electrically connected to the cathode of the power source 3. It should be noted that in the exemplary embodiment the object 1 can be any container like an object that includes two opposite inner walls, for example, a room in an exhibition center. The voltage of the power source 3 is very low and thus is not harmful to people. In the exemplary embodiment, the voltage of the power source 3 is 12 volts.

The floating lamp 2 includes a balloon 20 and a lighting element 22 mounted in the balloon 20. In the exemplary embodiment, an anode contact point 24 is mounted on the top of the balloon 20, and a cathode contact point 26 is mounted on the bottom of the balloon 26. The lighting element 22 is electrically connected to the contact points 24 and 26. In the exemplary embodiment, the cathode contact point 26 always contacts the second conductive element 16. The balloon 20 can be any typical lightweight balloon appropriate for being filled with a gas lighter than air such as a metalized nylon balloon to be filled with helium. To deploy the floating lamp 2, the balloon 20 is filled with a lighter than air gas enough to lift the floating lamp 2. When the floating lamp 2 is released it will float upward until making contact with the ceiling 10, causing the anode contact point 24 to contact the first conductive element 12, so that the first conductive element 12, the power source 3, the second conductive element 16, and the lighting element 22 form a closed circuit, and the lighting element 22 lights up from the power provided by the power source 3. In the exemplary embodiment, the lighting element 22 is an LED. When the balloon 20 is made from material such as material metalized nylon it can retain the lighter than air gas for extended periods. When too much gas has escaped from the balloon 20 to provide sufficient lift, the balloon 20 can be either replaced or refilled.

In the exemplary embodiment, the floating lamp 2 further includes a heat sink 28 mounted in the balloon 20. The heat sink 28 is for conducting heat of the lighting element 22.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A floating lamp system, comprising:

an object comprising a first inner wall and a second inner wall opposite to the first inner wall; wherein a first conductive element is mounted on the first wall and electrically connected to the anode of a power source; and a second conductive element is mounted on the second wall and electrically connected to the cathode of the power source; and a floating lamp comprising a balloon and a lighting element mounted in the balloon, wherein an anode contact point is mounted on the top of the balloon and a cathode contact point is mounted on the bottom of the balloon, the lighting element is electrically connected to the anode contact point and the cathode contact point, the cathode contact point always contacts the second conductive element; when the floating lamp floats and causes the anode contact point to contact with the first conductive element, the first conductive element, the power source, the second conductive element, and the lighting element form a closed circuit, and the lighting element is lit up.

2. The system as described in claim 1, wherein the lighting element is an LED.

3. The system as described in claim 1, wherein the voltage of the power source is 12 volts.

4. The electronic device as described in claim 1, wherein the floating lamp further comprises a heat sink mounted in the balloon.

* * * * *